US009982896B2

(12) United States Patent
Chen et al.

(10) Patent No.: US 9,982,896 B2
(45) Date of Patent: May 29, 2018

(54) WATER SUPPLY STRUCTURE OF LIQUID COOLING DEVICE, PUMP HAVING WATER SUPPLY STRUCTURE AND LIQUID COOLING DEVICE HAVING WATER SUPPLY STRUCTURE

(71) Applicant: COOLER MASTER CO., LTD., New Taipei (TW)

(72) Inventors: Hsin-Hung Chen, New Taipei (TW); Shui-Fa Tsai, New Taipei (TW); Shih-Yi Chang, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 355 days.

(21) Appl. No.: 14/866,616

(22) Filed: Sep. 25, 2015

(65) Prior Publication Data

US 2016/0115676 A1 Apr. 28, 2016

(30) Foreign Application Priority Data

Oct. 23, 2014 (CN) ..... 2014 2 0617470 U

(51) Int. Cl.
*F24D 1/08* (2006.01)
*F28F 27/00* (2006.01)

(52) U.S. Cl.
CPC ..... *F24D 1/08* (2013.01); *F28F 27/00* (2013.01)

(58) Field of Classification Search
CPC ..... F24D 1/08; F28F 7/00
USPC ..... 138/30, 31; 92/130 D
See application file for complete search history.

(56) References Cited

U.S. PATENT DOCUMENTS 3,172,466 A * 3/1965 Hirsch ..... H01J 7/24 165/104.31
3,238,932 A * 3/1966 Simpson ..... F01P 11/029 123/41.5
4,389,984 A * 6/1983 Destrampe ..... F01D 25/18 123/196 S
6,125,800 A * 10/2000 Lugs ..... F01P 11/029 123/41.02
9,038,668 B2 * 5/2015 Marin ..... F15B 1/24 138/30

* cited by examiner

*Primary Examiner* — Thomas E Lazo
(74) *Attorney, Agent, or Firm* — Muncy, Geissler, Olds & Lowe, P.C.

(57) ABSTRACT

A water supply structure of a liquid cooling device, a pump and a liquid cooling device having the water supply structure are disclosed. The water supply structure, disposed on the cooling device or on the pump, includes a lower lid, an upper lid, and a pressure control member. An outlet is in the lower lid and communicates with the cooling device or with the pump. The upper lid is combined on the lower lid. A chamber, formed between the lower lid and the upper lid, communicates with the outlet and accommodates a coolant. The pressure control member is moveable in the chamber and includes a piston and an elastic part controlling the piston to move inside the chamber. The elastic part pushes against the piston to move inside the chamber such that the coolant is injected into the cooling device until hydraulic pressure equilibrium is achieved.

19 Claims, 8 Drawing Sheets

WATER SUPPLY STRUCTURE OF LIQUID COOLING DEVICE, PUMP HAVING WATER SUPPLY STRUCTURE AND LIQUID COOLING DEVICE HAVING WATER SUPPLY STRUCTURE

BACKGROUND OF THE INVENTION

Field of the Invention

The present invention relates to a liquid cooling device, in particular, to a water supply structure of a liquid cooling device, a pump having the water supply structure, and a liquid cooling device having the water supply structure.

Description of Related Art

The traditional liquid cooling device mainly comprises plural pipes connected in series to components such as a water block, a pump, a cooling module, and a liquid reservoir. After operating the liquid cooling device for a long time, the amount of the coolant inside will decrease due to vaporization and thus the coolant will become inadequate. The amount of the coolant of the traditional liquid cooling device is added according to the user's observation of the coolant amount by opening the liquid reservoir manually to supplement the coolant.

However, the above procedures are made manually by the user, which not only cannot supplement the water timely, but also will cause the inconvenience because the user will easily forget to supplement water due to the carelessness. As a result, the liquid cooling device with insufficient coolant inside operates continuously and thus causes damage.

In view of this, the inventor pays special attention to research with the application of related theory and tries to improve and overcome the above disadvantages regarding the above related art. Finally, the inventor proposes the invention which is a reasonable design and overcomes the above disadvantages.

SUMMARY OF THE INVENTION

It is an objective of the present invention to provide a water supply structure of a liquid cooling device, a pump having the water supply structure, and a liquid cooling device having the water supply structure, which can timely supplement the coolant inside the liquid cooling device to prevent the generation of air and further reduce the side effects caused by the air to increase the life time thereof.

In order to achieve the above objective, the present invention provides a water supply structure of a liquid cooling device, disposed on the liquid cooling device. The water supply structure comprises a lower lid, an upper lid, and a pressure control member. An outlet is disposed in the lower lid. The outlet communicates with the interior of the liquid cooling device. The upper lid is combined on the lower lid. A chamber is formed between the lower lid and the upper lid. The chamber communicates with the outlet of the lower lid and accommodates a coolant. The pressure control member is disposed moveable in the chamber of the upper lid. The pressure control member comprises a piston and an elastic part controlling the piston to move inside the chamber. The elastic part pushes against the piston to move inside the chamber such that the coolant is injected into the liquid cooling device until hydraulic pressure equilibrium is achieved.

In order to achieve the above objective, the present invention also provides a pump having a water supply structure, comprising a pump and a water supply structure disposed on the pump. The pump is provided with an inlet.

The water supply structure comprises a lower lid, an upper lid, and a pressure control member. An outlet is disposed in the lower lid and communicates with the inlet of the pump. The upper lid is combined on the lower lid. A chamber is formed between the lower lid and the upper lid. The chamber communicates with the outlet of the lower lid and accommodates a coolant. A pressure control member is disposed moveable in the chamber of the upper lid. The pressure control member comprises a piston and an elastic part controlling the piston to move inside the chamber. The elastic part pushes against the piston to move inside the chamber such that the coolant is injected into the pump until hydraulic pressure equilibrium is achieved.

In order to achieve the above objective, the present invention further provides a liquid cooling device having a water supply structure, comprising a water block, a pump, a cooling module, a liquid reservoir, a plurality of pipes which are connected among the water block, the pump, the cooling module, and the liquid reservoir, and a water supply structure. The water supply structure comprises a lower lid, an upper lid, and a pressure control member. An outlet is disposed in the lower lid and communicates with the interior of the liquid cooling device. The upper lid is combined on the lower lid. A chamber is formed between the lower lid and the upper lid. The chamber communicates with the outlet of the lower lid and accommodates a coolant. The pressure control member is disposed moveable in the chamber of the upper lid. The pressure control member comprises a piston and an elastic part controlling the piston to move inside the chamber. The elastic part pushes against the piston to move inside the chamber such that the coolant is injected into the liquid cooling device until hydraulic pressure equilibrium is achieved.

DETAILED DESCRIPTION OF THE INVENTION

To further disclose the characteristics and technical details of the present invention, please refer to the following detailed description and accompanying figures. However, the accompanying figures are only for reference and explanation, but not to limit the scope of the present invention.

Figure 1:
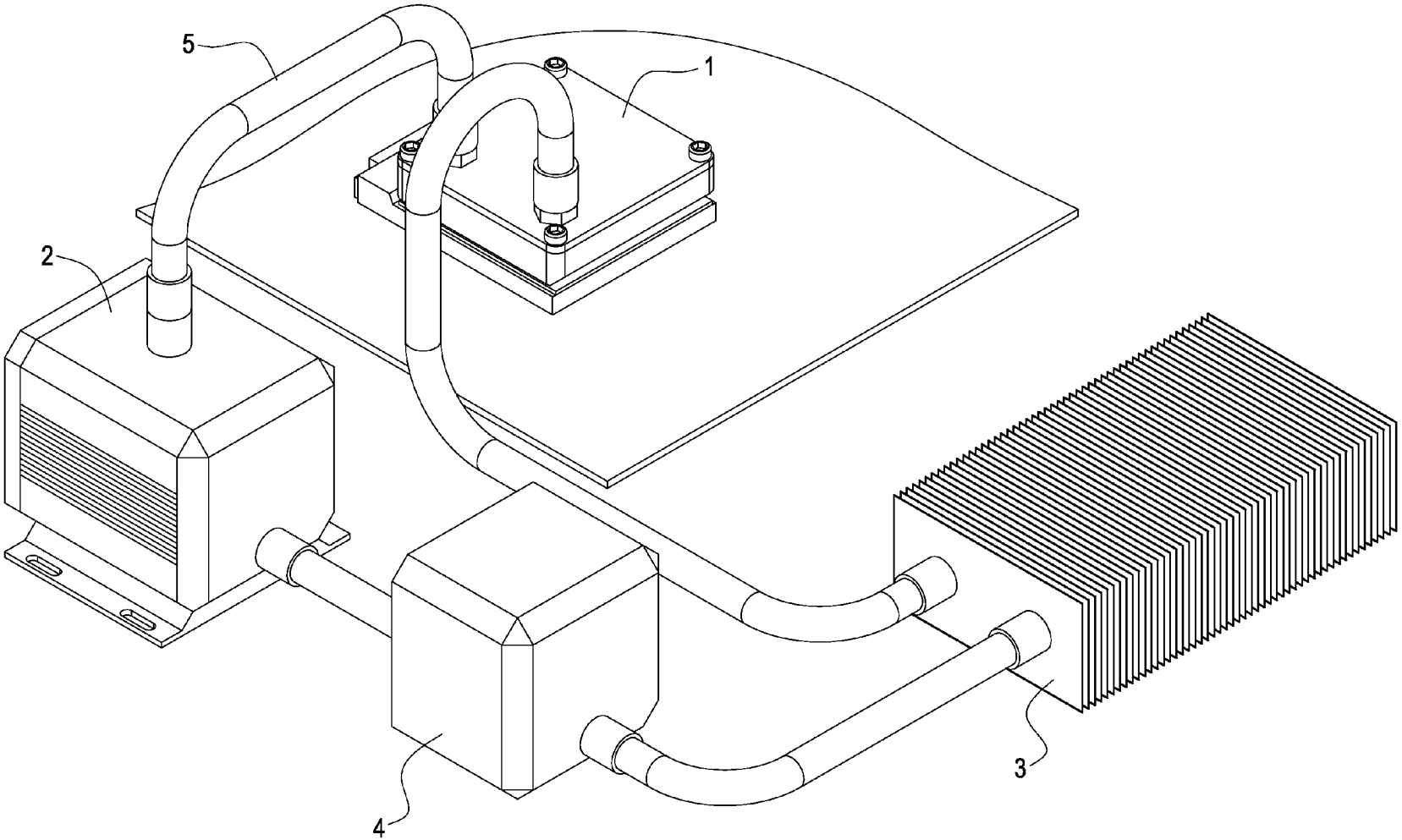
FIG. 1 is a perspective schematic view of the liquid cooling device of the present invention.
Figure 2:
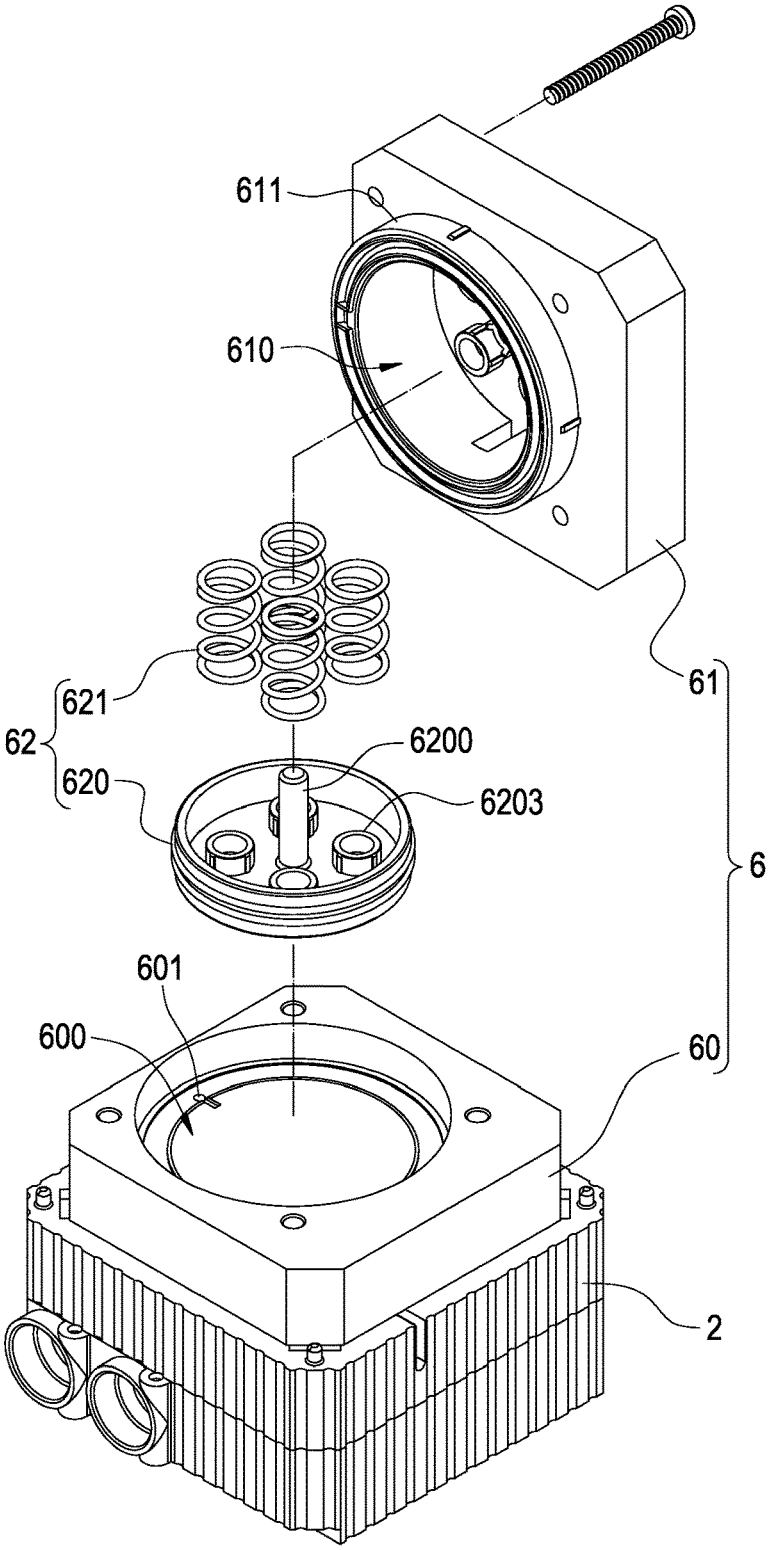
FIG. 2 is a perspective disassembled view of the pump having the water supply structure of the present invention.
Figure 3:
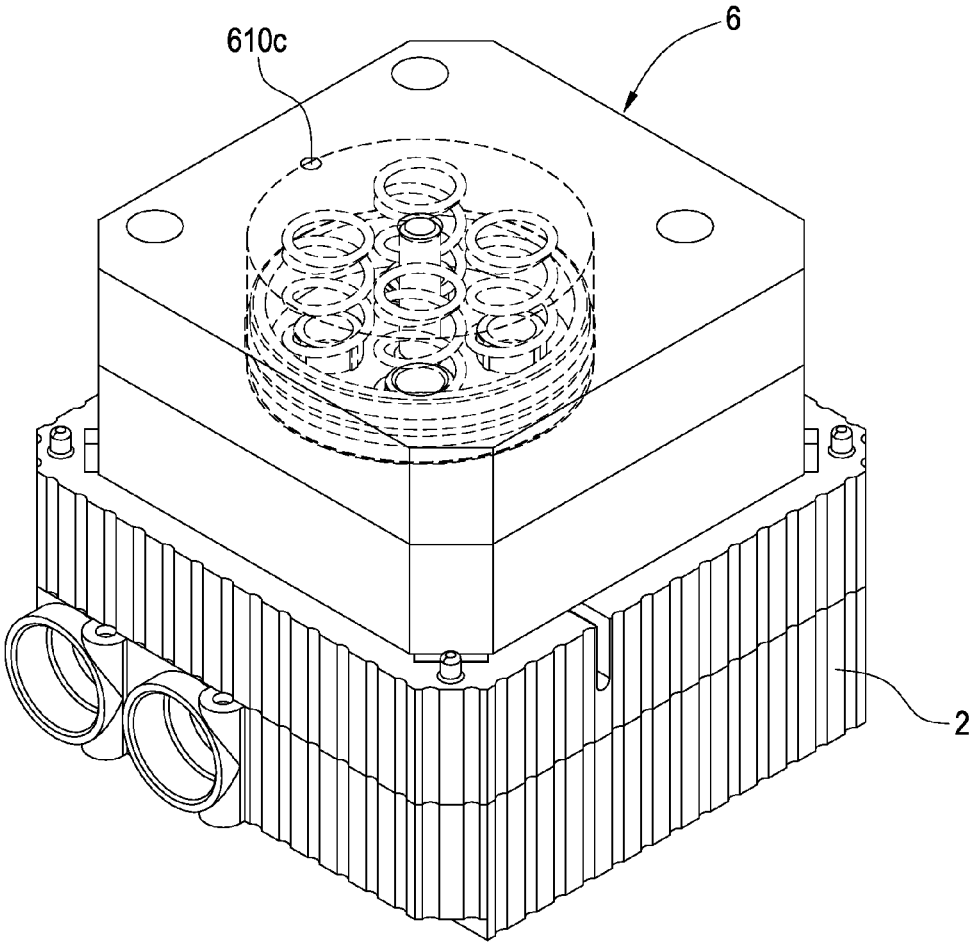
FIG. 3 is a perspective assembled view of the pump having the water supply structure of the present invention.
Figure 4:
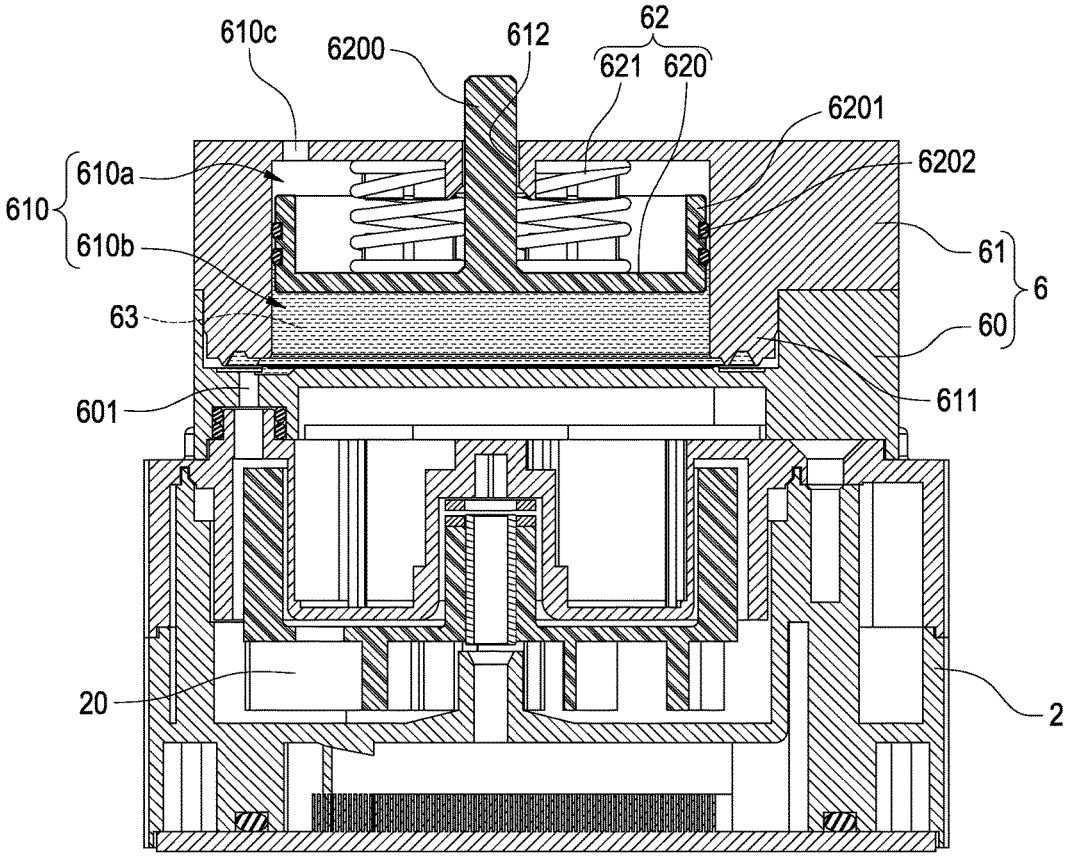
FIG. 4 is a cross-sectional assembled view of the pump having the water supply structure of the present invention.
Figure 7:
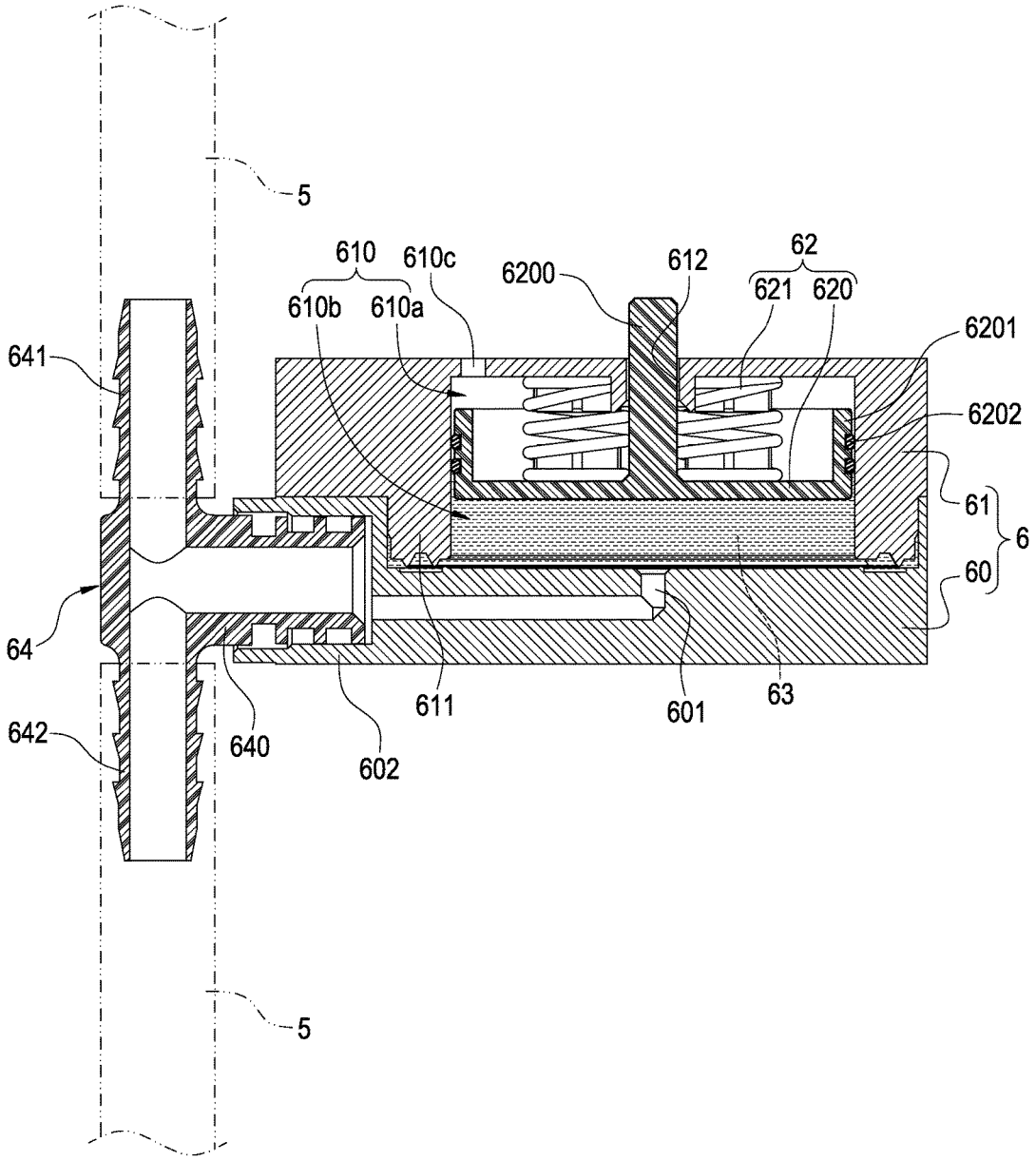
FIG. 7 is a schematic view of the water supply structure of the present invention connected to the pipes in series.

Please refer to FIGS. 1-3, which are the perspective schematic view of the liquid cooling device of the present invention, the perspective disassembled view of the pump of the present invention, and the perspective assembled view of the pump of the present invention, respectively. The present invention provides a water supply structure of a liquid cooling device, a pump having the water supply structure, and a liquid cooling device having the water supply structure. The liquid cooling device may comprise a water block 1, a pump 2, a cooling module 3, a liquid reservoir 4, and a plurality of pipes 5 which are connected among the water block 1, the pump 2, the cooling module 3, and the liquid reservoir 4. A water supply structure 6 used in the liquid cooling device can be disposed on any component of the liquid cooling device such as the pump 2, the cooling module 3, or can be connected among the pipes 5 in series, as shown in FIG. 7, to help the liquid cooling device provide a coolant supplement mechanism.

Please refer to FIGS. 2-5 together. In the current embodiment, the water supply structure 6 is disposed on the pump 2 and comprises a lower lid 60, an upper lid 61, and a pressure control member 62. The water supply structure 6 is filled with an adequate coolant 63 for filling into the pump 2.

The lower lid 60 is connected to the above-mentioned pump 2 and may have a connection hole 600 combined with the upper lid 61. The lower lid 60 is proved with an outlet 601 in the connection hole 600. The outlet 601 corresponds to the inlet 20 of the pump 2 such that when the coolant in the water supply structure 6 is delivered from the outlet 601, the coolant can be filled into the pump 2 through the inlet 20.

The upper lid 61 is combined on the lower lid 60 and a chamber 610 is formed between the lower lid 60 and the upper lid 61. The chamber 610 is used to accommodate the above-mentioned pressure control member 62 and the coolant 63. The upper lid 61 forms a chamber wall 611 surrounding outside the chamber 610. The chamber wall 611 is connected tightly to the connection hole 600 of the lower lid 60 correspondingly such that the chamber 610 communicates the outlet 601 of the lower lid 60.

The pressure control member 62 is disposed moveable in the chamber 610 of the upper lid 61 to divide the chamber 610 into an upper chamber 610*a* allowing an air access and a lower chamber 610*b* which is enclosed to accommodate the coolant 63. The upper lid 61 further comprises an air hole 610*c* communicating with the upper chamber 610*a*. The pressure control member 62 comprises a piston 620 and at least one elastic part 621 controlling the piston 620 to move inside the chamber 610 such that the piston 620 can move up and down in the chamber 610. In the current embodiment, a shaft 6200 is disposed on the piston 620. The upper lid 61 is provided with a throughhole 612 through which the shaft 6200 is moveably penetrated such that the shaft 6200 is disposed through the throughhole 612, the piston 620 is located in the chamber 610, and the elastic part 621 in the chamber 610 is pressed against between the upper lid 61 and the piston 620. Further, the elastic part 621 pushes against the piston 620 in the chamber 610 to move downward until the hydraulic pressure equilibrium in the pump 2 is achieved. Moreover, a sidewall 6201 can be disposed surrounding the piston 620. The sidewall 6201 corresponds to the chamber 610. A waterproof gasket 6202 is disposed between the sidewall 6201 and the chamber 610. Also, the elastic part 621 may be plural and a plurality of positioning rings 6203 are disposed on the piston 620 to position the elastic parts 621 to facilitate the positioning and assembly of the elastic parts 621.

Figure 5:
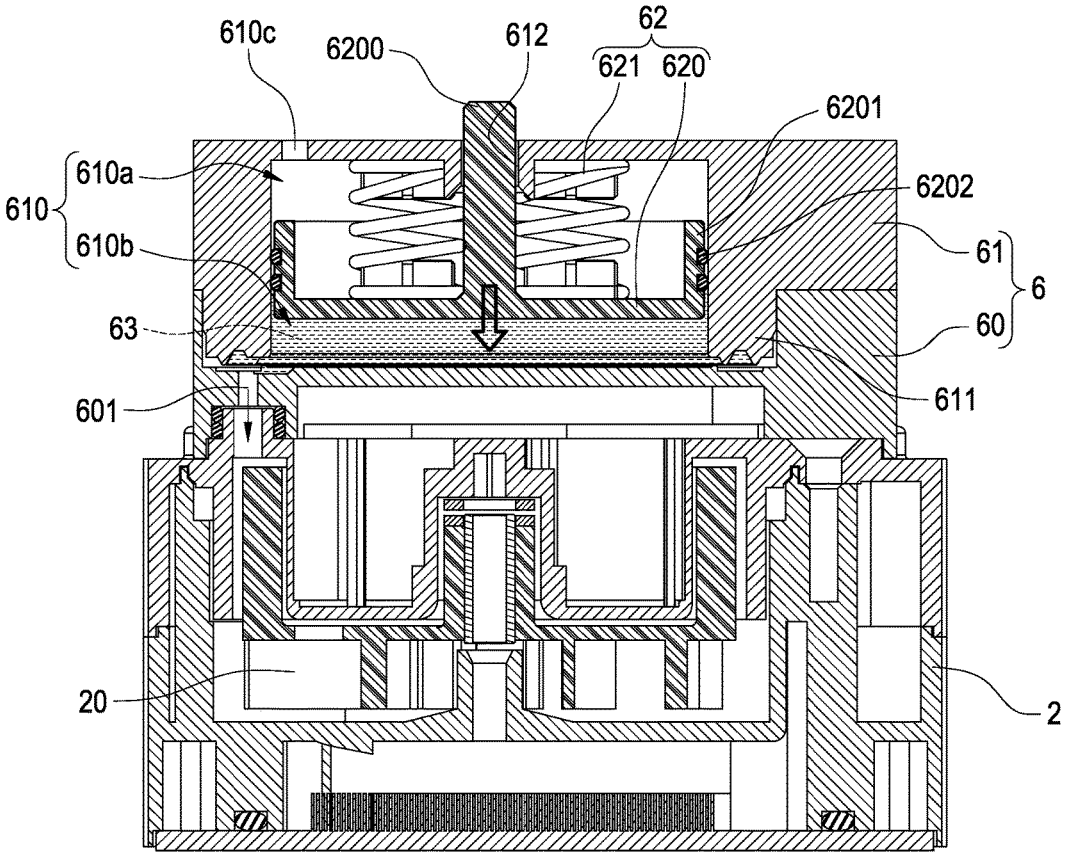
FIG. 5 is a schematic view of the pump having the water supply structure of the present invention in actuation.

Besides, as shown in FIG. 5, when the coolant in the pump 2 decreases, it means the hydraulic pressure in the pump 2 decreases. At this moment, the coolant 63 in the chamber 610 can be injected into the pump 2 through the outlet 601 and inlet 20 by the pressure control member 62 until the hydraulic pressure equilibrium inside is achieved because the water supply structure 6 communicates with the inlet 20 of the pump 2 via the outlet 601. That is, the reduced amount of the coolant in the pump 2 can be supplemented automatically.

Figure 6:
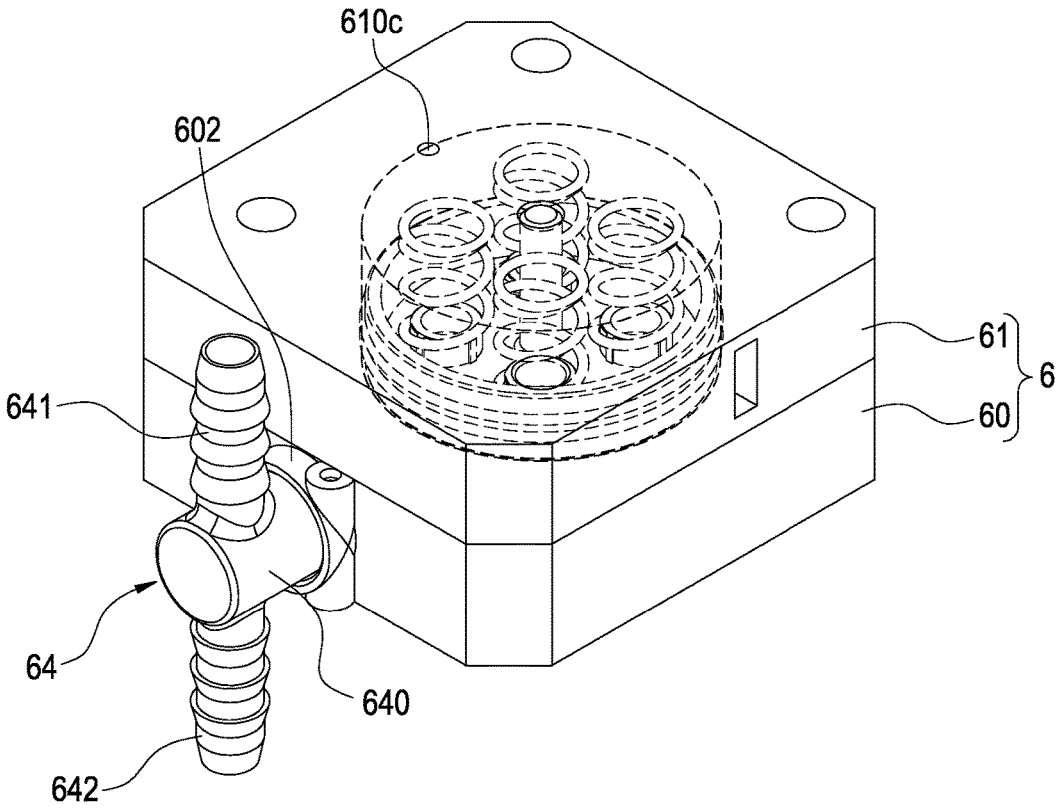
FIG. 6 is a perspective assembled view of the water supply structure of the present invention.

Also, as shown in FIGS. 6 and 7, the water supply structure 6 alone can be connected in series to the pipes 5 of the liquid cooling device in which the lower lid 60 of the water supply structure 6 is provided with a connection port 602 which communicates with the outlet 601 such that the connection port 602 is provided with a pipe connector 64. The pipe connector 64 comprises a first connecting part 640 and two second connecting parts 641, 642 bifurcating and communicating with each other. The first connecting part 640 is connected to the connection port 602; the two second connecting parts 641, 642 are individually connected among the pipes 5 of the liquid cooling device. Thus, the coolant 63 in the chamber 610 can likewise be injected into the liquid cooling device through the outlet 601 and the inlet 20 by the pressure control member 62.

Figure 8:
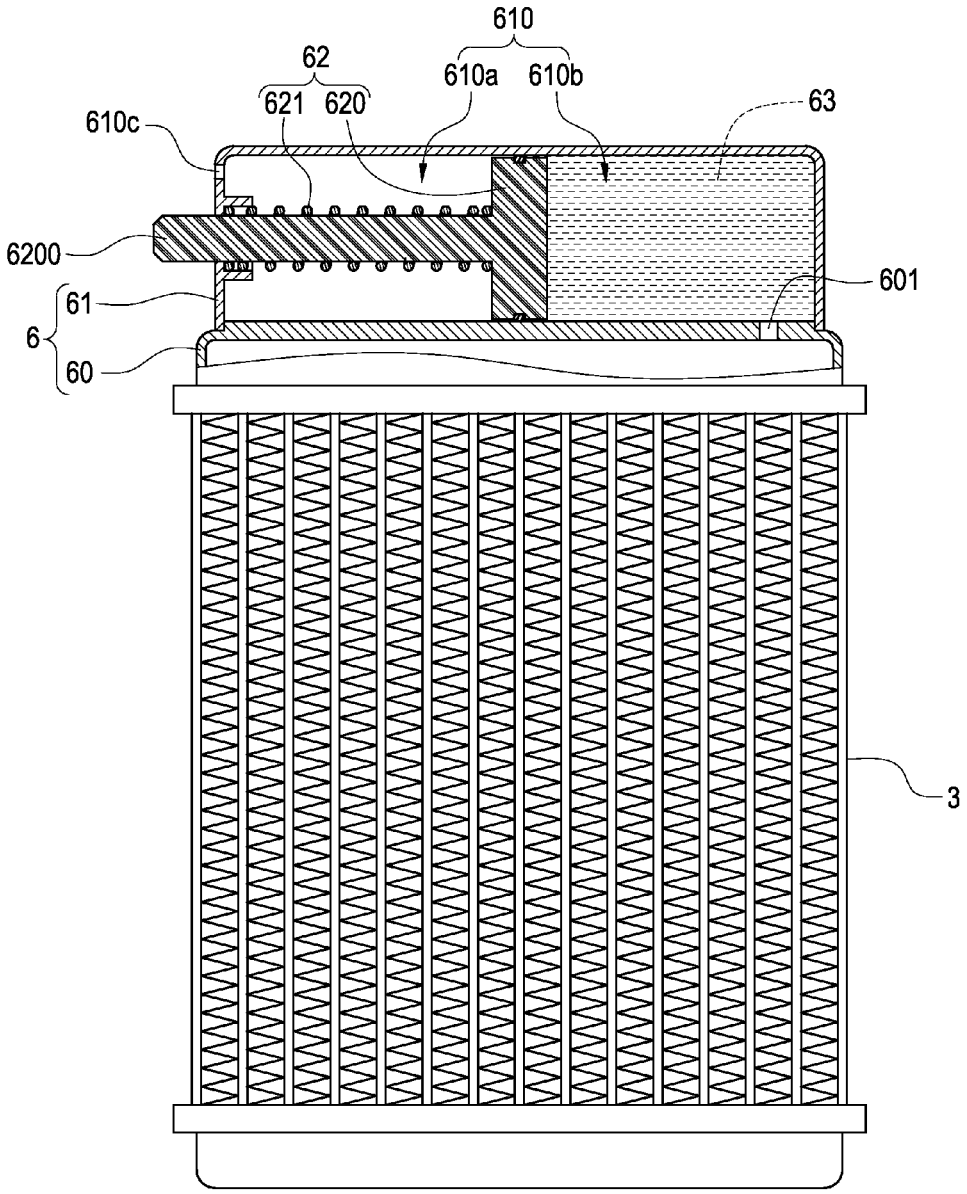
FIG. 8 is a schematic view of the water supply structure of the present invention disposed on the cooling module.

Additionally, as shown in FIG. 8, the water supply structure 6 can also be disposed on the cooling module 3 of the liquid cooling device in which the lower lid 60 of the water supply structure 6 communicates with the cooling module 3 through the outlet 601. As such, the coolant 63 in the chamber 610 can likewise be injected into the cooling module through the outlet 601 by the pressure control member 62.

Accordingly, by the assembly of the above structure, the water supply structure of the liquid cooling device, the pump having the water supply structure, and the liquid cooling device having the water supply structure of the present invention can be obtained.

Therefore, by means of the water supply structure of the liquid cooling device, the pump having the water supply structure, and the liquid cooling device having the water supply structure of the present invention, which can supplement the coolant in the liquid cooling device timely to prevent the generation of air and reduce the side effects caused by the air to increase the life time thereof.

In summary, the present invention is really an outstanding product, which can achieve the expected objective and overcome the disadvantages of the prior art. Also, the present invention is indeed novel, useful, and non-obvious to be patentable. Please examine the application carefully and grant it as a formal patent for protecting the rights of the inventor.

The embodiments described above are only preferred ones of the present invention and not to limit the claimed scope of the present invention. Therefore, all the equivalent modifications and variations applying the specification and figures of the present invention should be embraced by the claimed scope of the present invention.

What is claimed is:

1. A water supply structure of a liquid cooling device, disposed on the liquid cooling device, the water supply structure comprising:

a lower lid in which an outlet is disposed, wherein the outlet communicates with an interior of the liquid cooling device;

an upper lid combined on the lower lid wherein a chamber is formed between the lower lid and the upper lid, wherein the lower lid has a connection hole combined with the upper lid, wherein the chamber communicates with the outlet of the lower lid and accommodates a coolant; and a pressure control member disposed moveable in the chamber of the upper lid, wherein the pressure control member comprises a piston and an elastic part controlling the piston to move inside the chamber, wherein the elastic part pushes against the piston to move inside the chamber such that the coolant is injected into the liquid cooling device until hydraulic pressure equilibrium is achieved.

2. The water supply structure of the liquid cooling device according to claim 1, wherein the upper lid forms a chamber wall surrounding outside the chamber, wherein the chamber wall is connected tightly to the connection hole of the lower lid correspondingly.

3. The water supply structure of the liquid cooling device according to claim 1, wherein a shaft is disposed on the piston of the pressure control member, wherein the upper lid is provided with a throughhole through which the shaft is moveably penetrated such that the shaft is disposed through the throughhole, the piston is located in the chamber, and the elastic part in the chamber is pressed against between the upper lid and the piston.

4. The water supply structure of the liquid cooling device according to claim 1, wherein a sidewall is disposed surrounding the piston, wherein the sidewall corresponds to the chamber, wherein a waterproof gasket is disposed between the sidewall and the chamber.

5. The water supply structure of the liquid cooling device according to claim 1, wherein the elastic part is plural and a plurality of positioning rings are disposed corresponding to the elastic parts on the piston for positioning.

6. The water supply structure of the liquid cooling device according to claim 1, wherein the lower lid is provided with a connection port which communicates with the outlet.

7. The water supply structure of the liquid cooling device according to claim 6, wherein the connection port is provided with a pipe connector.

8. The water supply structure of the liquid cooling device according to claim 7, wherein the pipe connector comprises a first connecting part and two second connecting parts bifurcating and communicating with each other, wherein the first connecting part is connected to the connection port, wherein the two second connecting parts are individually connected to the liquid cooling device.

9. A pump having a water supply structure, comprising:

a pump provided with an inlet; and a water supply structure disposed on the pump, the water supply structure comprising:

a lower lid in which an outlet is disposed, wherein the outlet communicates with the inlet of the pump;

an upper lid combined on the lower lid, wherein a chamber is formed between the lower lid and the upper lid, wherein the lower lid has a connection hole combined with the upper lid, wherein the chamber communicates with the outlet of the lower lid and accommodates a coolant; and a pressure control member disposed moveable in the chamber of the upper lid, wherein the pressure control member comprises a piston and an elastic part controlling the piston to move inside the chamber, wherein the elastic part pushes against the piston to move inside the chamber such that the coolant is injected into the pump until hydraulic pressure equilibrium is achieved.

10. The water supply structure of the liquid cooling device according to claim 1, wherein the outlet of the lower lid is disposed in the connection hole.

11. The pump having the water supply structure according to claim 9, wherein the outlet of the lower lid is disposed in the connection hole.

12. The pump having the water supply structure according to claim 11, wherein the upper lid forms a chamber wall surrounding outside the chamber, wherein the chamber wall is connected tightly to the connection hole of the lower lid correspondingly.

13. The pump having the water supply structure according to claim 11, wherein a shaft is disposed on the piston of the pressure control member, wherein the upper lid is provided with a throughhole through which the shaft is moveably penetrated such that the shaft is disposed through the throughhole, the piston is located in the chamber, and the elastic part in the chamber is pressed against between the upper lid and the piston.

14. The pump having the water supply structure according to claim 11, wherein a sidewall is disposed surrounding the piston, wherein the sidewall corresponds to the chamber, wherein a waterproof gasket is disposed between the sidewall and the chamber.

15. The pump having the water supply structure according to claim 11, wherein the elastic part is plural and a plurality of positioning rings are disposed corresponding to the elastic parts on the piston for positioning.

16. A liquid cooling device having a water supply structure, comprising a water block, a pump, a cooling module, a liquid reservoir, a plurality of pipes which are connected among the water block, the pump, the cooling module, and the liquid reservoir, and a water supply structure; the water supply structure comprising:

a lower lid in which an outlet is disposed, wherein the outlet communicates with an interior of the liquid cooling device;

an upper lid combined on the lower lid, wherein a chamber is formed between the lower lid and the upper lid, wherein the chamber communicates with the outlet of the lower lid and accommodates a coolant; and a pressure control member disposed moveable in the chamber of the upper lid and dividing the chamber into an upper chamber allowing an air access and a lower chamber which is enclosed to accommodate the coolant, wherein the upper lid comprises an air hole communicating with the upper chamber, wherein the pressure control member comprises a piston and an elastic part controlling the piston to move inside the chamber, wherein the elastic part pushes against the piston to move inside the chamber such that the coolant is injected into the liquid cooling device through the outlet until hydraulic pressure equilibrium is achieved.

17. The liquid cooling device having a water supply structure according to claim 16, wherein the water supply structure is disposed on the pump or on the cooling module.

18. The liquid cooling device having a water supply structure according to claim 16, wherein the water supply structure is connected among the pipes in series.

19. A cooling module having a water supply structure, comprising:

a cooling module; and a water supply structure disposed on the cooling module and comprising:

a lower lid in which an outlet is disposed, wherein the outlet communicates with an interior of the cooling module;

an upper lid combined on the lower lid, wherein a chamber is formed between the lower lid and the upper lid, wherein the chamber communicates with the outlet of the lower lid and accommodates a coolant; and a pressure control member disposed movable in the chamber of the upper lid and dividing the chamber into an upper chamber allowing an air access and a lower chamber which is enclosed to accommodate the coolant, wherein the pressure control member comprises a piston and an elastic part controlling the piston to move inside the chamber, wherein the elastic part pushes against the piston to move inside the chamber such that the coolant is injected into the cooling module through the outlet until hydraulic pressure equilibrium is achieved.

* * * * *